United States Patent [19]

Okamoto et al.

[11] 4,036,008

[45] July 19, 1977

[54] ELECTRONIC TIMEPIECE

[75] Inventors: Yoshihiko Okamoto; Toshio Abe, both of Yokohama; Kazuhiro Hirose, Kawasaki; Saburo Nakajima, Kawasaki; Hiroshi Saito, Kawasaki, all of Japan

[73] Assignee: Tokyo Shibaura Electric Co., Ltd., Tokyo, Japan

[21] Appl. No.: 703,009

[22] Filed: July 6, 1976

[30] Foreign Application Priority Data

July 7, 1975 Japan ..... 50-83333

[51] Int. Cl.[2] ..... G04B 27/00

[52] U.S. Cl. ..... 58/85.5; 58/50 R

[58] Field of Search ..... 58/4 A, 23 R, 50 R, 58/58, 85.5

[56] References Cited

U.S. PATENT DOCUMENTS

| | | | |
|---|---|---|---|
| 3,756,013 | 9/1973 | Berget et al. | 58/50 R |
| 3,760,582 | 9/1973 | Thiess et al. | 58/50 R |
| 3,828,548 | 8/1974 | Martin | 58/50 R |
| 3,961,472 | 6/1976 | Riehl | 58/4 A |

*Primary Examiner*—Robert K. Schaefer
*Assistant Examiner*—Vit W. Miska
*Attorney, Agent, or Firm*—Finnegan, Henderson, Farabow & Garrett

[57] ABSTRACT

In a mode switching type electronic timepiece of the type wherein time correction is made under a correction mode, where the same data is displayed over a predetermined period in the correction mode, the operation of the timepiece is automatically transferred from the correction mode in which power is consumed for the time display to a nondisplay mode in which no power is consumed for the time display or a specific mode in which less power is consumed.

2 Claims, 2 Drawing Figures

DISPLAY DEVICE
Ih
Im
12
LOGICAL TIME COUNTING CIRCUIT
8
Mh
Sh
Mm
Sm
Gh
Gm
10
11
DISPLAY MODE DESIGNATION CIRCUIT
7
S
R
CORRECTION MODE DESIGNATION CIRCUIT
9
COUNTER CIRCUIT
6
T
4
5
3
FROM SWITCHING BUTTON
S2
S1

1
2
S1
S2

ELECTRONIC TIMEPIECE

This invention relates to a mode switching type electronic timepiece capable of correcting the second, minute, hour, etc. under a condition set to a correction mode.

With recent advance of integrated circuit technique the mechanical component parts of a timepiece are gradually replaced by electronic elements. Now, all electronic type timepieces are used widely. Like a mechanical timepiece, in an electronic timepiece it is also necessary to set and correct the second, etc., but decrease in the power consumption of a battery used as a driving source is the most essential. Since a battery used in an electronic timepiece generally has a small capacity it is necessary to decrease as far as possible the power consumption. Especially, in an electronic timepiece wherein luminous elements such as light emitting diodes are used as the display elements, power consumption increase when the time is displayed continuously. For example, in a battery type wrist watch display of the time becomes impossible in less than one day should the display is made continuously.

For this reason, in order to decrease the power consumption required for the time display a system has been used wherein the display is not made normally but made only when it is necessary, for example, for confirming, correcting and setting the time.

Figure 1:
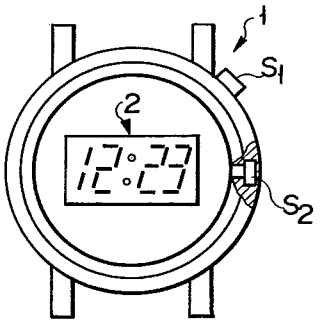

As shown in FIG. 1, an electronic timepiece 1 utilzing such a display system is provided with a first switching button $S_1$ for selectively switching the display state between a display mode and a non-display mode, and second switching button $S_2$ for selectively switching the time correction mode between an hour correction mode and a minute correction mode.

The switching button $S_2$ is not projected to the outside of the watch casing for the purpose of preventing it from being inadvertently depressed by collision with other objects as in a wrist watch.

To correct the time, the switching button $S_1$ is depressed by a finger to switch from the non-display mode to the display mode and then switching button $S_2$ is depressed by a pin, for example, to set the time correction mode. Then, of the digits of the display unit 2, only the digits for displaying hours, that is the hour digits, for example 12 shown in FIG. 1, are displayed.

However, it such time correction operation is interrupted by some unexpected cause, for example, a telephone call or a visitor so that the correction mode is continued the display would be continued for many hours until the wearer comes to aware that he has forgotten the time correction operation.

When the correction mode of the timepiece is continued in this manner, and when it is assumed that the battery has a capacity of 120 mAH, that the average number of lighted segments utilized for the display is 5, and that a brightness of 20 $\mu$cd is necessary at a duty cycle of $\frac{1}{4}$, usually a current of 0.9 mA flows per segment so that the capacity of the battery would be exhausted in 120 mAH/5 $\times$ 0.9 mA = 26.7 hours, thus losing the display ability.

Thus, in the prior art electronic timepiece, if the correction mode is inadvertently continued for a long period at the time of the time correction operation, for example, the battery would completely discharge thereby losing the ability to display.

Advancement of the electrotechnique makes it possible to display not only hours, minutes and seconds, but also dates, months, weeks or even years. However, for the purpose of simplifying the display surface these plurality of display items are switched between a plurality of display modes thereby providing a series of displays. Accordingly, increase in the display modes complicates the correction operation. Under these circumstances the defects described above becomes important. More particularly, as the time required for the time correction increases the possibility of interrupting the correction operation for some reason and there is an increased provability of inadvertently continuing the correction mode.

It is an object of this invention to provide an improved electronic timepiece capable of automatically switching from a correction mode to a non-display mode consuming no power for the time display not consuming any power for the time display or to a specific display mode that consumes less power if the correction operation were interrupted for a predetermined period in a set state in which time correction is possible, that is in the correction mode.

According to this invention there is provided an electronic timepiece comprising a time counting circuit generating a time information signal, an advance pulse and a clock pulse; a first designation circuit to be set by a signal from first externally operable input means to supply a time information output designation signal to the logical time counting circuit for causing the same to produce a time information; a display device for displaying a time corresponding to the time information produced by the logical time counting circuit; a second designation circuit to be set by a signal from second externally operable input means to supply a correction mode designation signal to the logical time counting circuit for setting the same to a correctable condition; a logical circuit responsive to a signal produced by the first input means when the logical time counting circuit is set at a correction mode for supplying the advance pulse to a time correction signal input terminal of the logical time counting circuit; a counter circuit for counting the number of the clock pulses produced by the logical time counting circuit for providing a reset signal to the first and second designation circuits when a predetermined number of the clock pulses has been counted thus resetting the first and second designation circuits for stopping the output designation signals produced thereby; said counter circuit being connected to be reset by a signal produced by the first input means; whereby when the display device displays the same data for a predetermined period under a condition wherein the logical time counting circuit is set to the correction mode in which power is consumed for the time display the timepiece is automatically transferred to a non-diaplay mode in which no power is consumed for the time display by the reset signal from the counter circuit.

Figure 2:
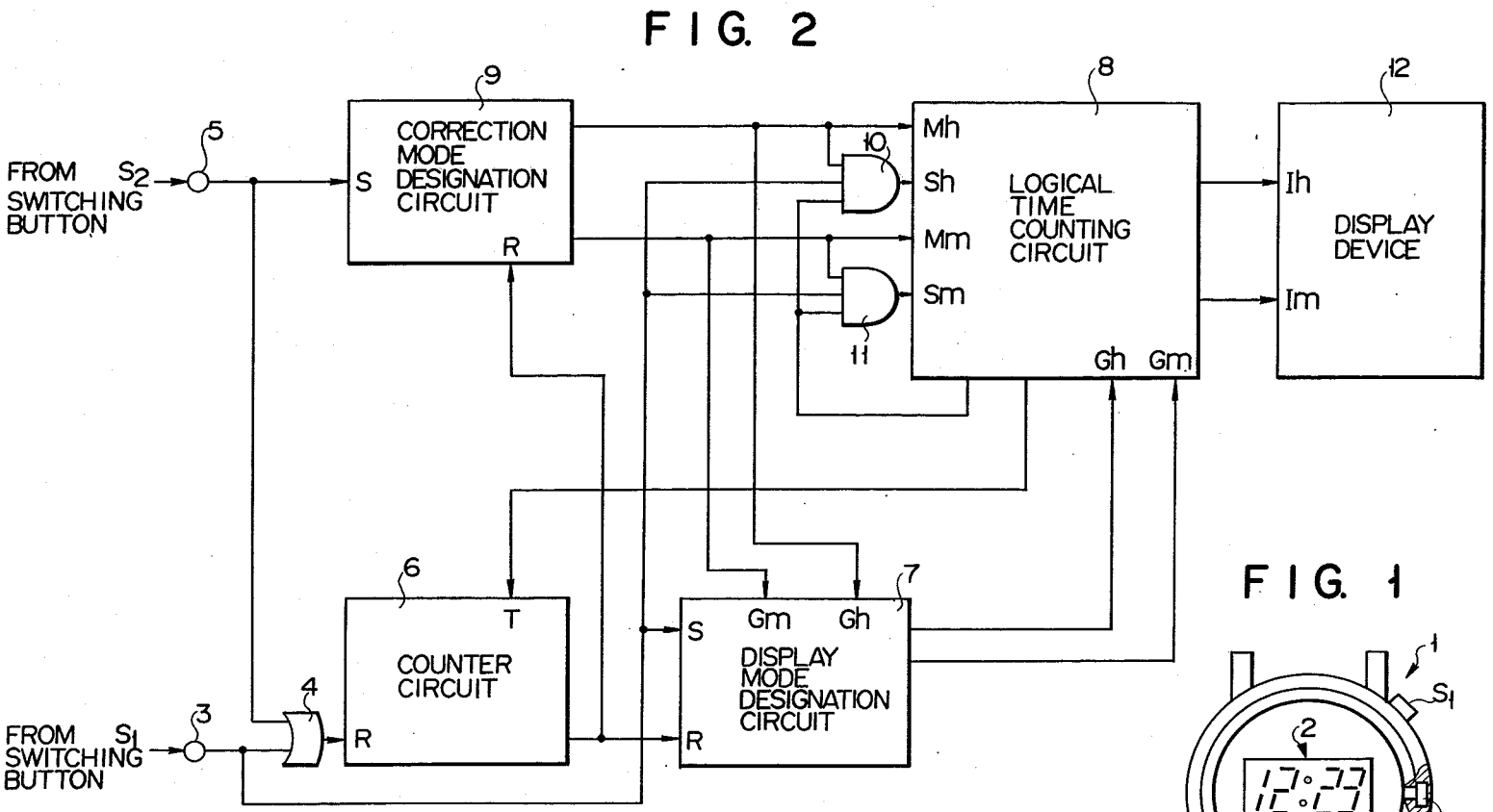

This invention can be more fully understood from the following detailed description taken in conjunction with the accompanying drawings in which:

FIG. 1 is a plan view showing the appearance of an electronic wrist watch; and FIG. 2 is a block diagram of the electric circuit of an electronic timepiece embodying the invention.

One embodiment of the electronic timepiece of this invention shown in FIG. 2 comprises switching buttons $S_1$ and $S_2$ for transferring between a display mode and a non-display mode and between a minute correction mode and a hour correction mode respectively, which are operable from the outside of the timepiece. Button $S_1$ is connected to a first input terminal of an OR gate circuit 4 through a terminal 3, and the other input terminal of the OR gate circuit 4 is connected to the set terminals of a correction mode designation circuit 9 and to button $S_2$ via terminal 5. One output terminal of the correction mode designation circuit 9 is connected to the hour correction mode setting terminal Mh of a logical time counting circuit 8, to one input of a first AND gate circuit 10 and the first input terminal Gh of a display mode designation circuit 7. The second output of the correction mode designation circuit 9 is connected to the minute correction setting terminal Mm of the logical time counting circuit 8, to one input of a second AND gate circuit 11 and to a second input terminal Gm of the display mode designation circuit 7. The output terminal of the OR gate circuit 10 is connected to a reset terminal R of a counter circuit 6 that counts the number of the clock pulses, while the output terminal of the counter circuit 6 is connected to the reset terminal R of the display mode designation circuit 7 that controls the display and non-display of the time. The set terminal S of the display mode designation circuit 7 is connected to button $S_1$ via terminal 3. The first and second output terminals of the display mode designation circuit 7 is connected to the hour and minute display mode signal input terminals Gh and Gm of the logical time counting circuit 8 respectively. The reset terminal R of the correction mode designation circuit 9 is connected to the output terminal of counter circuit 6. The second input terminals of the first and second OR gate circuits 10 and 11 are connected to button 3 via terminal 3, while the third input terminals of these AND gate circuits are connected to the advance pulse output terminal of the logical time counting circuit 8. The output terminal of the first AND gate circuit 10 is coupled to the hour correction terminal Sh of the logical time counting circuit 8, while the output terminal of the second OR gate 11 is connected to the minute correction terminal Sm of the logical time counting circuit 8.

The clock pulse output terminal of the logical time counting circuit 8 is connected to a input terminal of the counter circuit 6, whereas the output terminals of the time counting circuit 8 are connected to a display circuit 12.

To aid the understanding of the operation of the electronic timepiece circuit shown in FIG. 2, the meaning of the following table will firstly be described.

Table

| Mode | Switching button operation $S_1$ | Switching button operation $S_2$ | Automatic reset |
|---|---|---|---|
| non-display mode | ◎ | ◎ | ↑ ↑ ↑ |
| hour and minute display mode | ↓ | ↓ | |
| hour correction mode | | ◎ | |
| minute correction mode | | ↓ | |

This Table shows various set modes of the electronic timepiece of this invention, the operations of the switching buttons $S_1$ and $S_2$ for setting the modes, and the automatic reset to the non-display mode. Double circle symbols in the columns of the buttons $S_1$ and $S_2$ show manual operation of the buttons. This table means that (1) the electronic timepiece can selectively be set to the non-display mode, hour and minute display mode, the hour correction mode or the minute correction mode, (2) that while respective modes can be set by operating respective buttons $S_1$ and $S_2$, where buttons $S_1$ and $S_2$ are not operated, the electronic timepiece is set to the non-display mode and that the mode is switched to the display mode in which the hour and minute are displayed by manually operating button $S_1$, that under these conditions when the button $S_2$ is operated the hour correction mode is set for correcting the hours, and that when button $S_2$ is operated once more the minute correction mode is set for setting the minute, and (3) that the timepiece can be automatically reset to the non-display mode either from the hour and minute display mode, hour connection mode or minute connection mode.

The time confirming operation and the automatic resetting operation to the non-display mode of the electronic timepiece circuit shown in FIG. 2 will now be described. At first button $S_1$ is depressed to apply a signal to the set terminal of the display mode designation circuit 7 via the terminal 3. The display mode designation circuit 7 is set by this signal to provide hour and minute display mode designation signals to the logical time counting circuit 8. The hour display mode designation signal designates only an hour display and the minute display mode designation signal designates only minute display. The logical counting circuit 8 may be a well known circuit of type in which, for example, time information counts binary.

The display device 12 comprises, for example, light emitting diodes, for providing a visible display of the time in response to the minute and hour informations from the logical time counting circuit 8. Thus the time can be confirmed by depressing button $S_1$ for causing corresponding display elements of the display device 12 to luminescent.

Upon depression of button $S_1$, the signal impressed upon terminal 3 is applied to the display mode designation circuit 7 and also to the reset terminal R of the counter circuit 6 via the OR gate circuit 4, the counter circuit 6 acting as a timer. A clock pulse having a predetermined period is normally applied to the counter circuit 6 from the logical time counting circuit 8. When the counter circuit 6 counts a predetermined number, for example 60 of the clock pulses, in other words when 60 seconds elapse when the period of the clock pulse is equal to 1 second, the counter produces an output signal. Consequently, after being reset by the signal produced by button $S_1$, the counter circuit 6 counts the number of the clock pulses from the logical time counting circuit 8 and produces an output when it counts a predetermined number of the clock pulses or after a predetermined period. The output from the counter circuit 6 is applied to the reset terminal R of the display mode designation circuit 7 thus resetting the same. When reset in this manner, the display mode designation circuit 7 terminals its display mode designation signals to the logical time counting circuit 8. Accordingly, the information output signals applied to the display device 12 is stopped thus switching the display device 12, that is, the timepiece from the display mode in which power is consumed for the time display to the non-display mode in which no power is consumed for the time display.

The time correction operation and the automatically resetting to the non-display mode are performed in the following manner.

To this end, the button $S_2$ is depressed to apply a signal to the input terminal 5. This signal is applied to the set terminal S of the correction mode designation circuit 9 as a shift signal and to the reset terminal R of the counter circuit 6 via the OR gate circuit 4 to act as a reset signal. The correction mode designation circuit 9 is constructed such that each time the input signal is applied it alternately produces a hour correction mode designation signal and a minute correction mode designation signal. The hour correction mode designation signal and the minute correction mode designation signal are applied in the hour correction mode setting terminal Mh and the minute correction mode setting terminal Mm, respectively, of the logical time counting circuit 8 to set it to the hour correction mode or the minute correction mode. In other words, the timepiece is set to the hour correction mode or the minute correction mode.

When button $S_2$ is depressed only once the correction mode designation circuit 9 produces an hour correction mode designation signal which is applied to the hour correction mode setting terminal Mh of the logical time counting circuit 8 thus setting the same to the hour correction mode. Further, the hour correction designation signal from the correction mode designation circuit 9 is applied to one input of the first AND gate circuit 10 which produces an hour correction signal. As shown, an advance pulse from the logical time counting circuit 8 is normally applied to the other input of the first AND gate circuit 10. In this example, the period of the advance pulse is set to one second, for example. However, it should be understood that this period is not always equal to one second because the advance pulse is used to advance the time information of the hour digits during the hour correction mode and to advance the time information of the minute digits during the minute correction mode.

Then, when button $S_1$ is depressed a signal is applied through terminal 3 as has been described above in connection with the time confirmation operation. In response to this input signal the counter circuit 6 is reset to begin a new counting operation. On the other hand, the display mode designation circuit 7 is set to supply a display mode designation signal to the logical time counting circuit 8. During the hour correction mode, since the hour correction mode designation signal is applied to the display mode designation circuit 7 from the correction mode designation circuit 9, only the hour display mode designation signal or the signal which designates only the hour display is produced from the display mode designation circuit 7. Accordingly, the display device 12 displays only the content of the hour digits. Further, the signal from terminal 3 is also applied to one input of the first AND gate circuit 10. Three input signals, that is, the hour correction mode designation signal, the advance pulse and the signal produced by button $S_1$ are applied to the three input terminals of the first AND gate circuit 10 thus enabling the same. Accordingly, the advance pulse having a period of one second is applied to the hour correction signal input terminal Sh of the logical time counting circuit 8 via the first AND gate circuit 10, so that the time information of the logical time counting circuit 8 is shifted by the advance pulse while the button $S_1$ is being depressed. In other words, the time information is shifted one hour at each one second. The wearer continues depress button $S_1$ while watching the manner of shifting the hours display on the face plate and releases button $S_1$ when a correct time is displayed thereby terminating the shifting operation. At this time a correct time is displayed.

To correct minutes, button $S_2$ is depressed again to set the logical time counting circuit 8 to the minute correction mode. Thereafter, substantially the same operation as the hour correction is performed. More particularly, as above described, depression of button $S_2$ applies a signal to the set terminal of the correction mode designation circuit 9 via terminal 5 whereby the correction mode designation signal from the correction mode designation circuit 9 is switched from the hour correction mode designation signal to the minute correction mode designation signal.

The minute correction mode designation signal is applied to the minute correction mode setting terminal Mm of the logical time counting circuit 8 to transfer it to the minute correction mode. The minute correction mode designation signal is also applied to one input to the second AND gate circuit 11. Similar to the hour correction mode, the advance pulse from the logical time counting circuit 8 is applied to the other input of the second AND gate circuit 11.

When button $S_1$ is depressed at this time counter circuit 6 is reset to renew its counting operation. On the other hand, the display mode designation circuit 7 is set to send a display mode designation signal to the logical time counting circuit 8.

Like the hour correction operation, during the minute correction mode a minute correction mode designation signal is applied to the display mode designation circuit 7 from the correction mode designation circuit 9 so that only the minute display mode designation signal or the signal which designates only the minute display is produced from the display mode designation circuit 7. Accordingly, in this case the display device 12 displays only the content of the minute digits.

The signal produced by button $S_1$ is also applied to one input of the second AND gate circuit 11 so that three input signals, that is the minute correction mode designation signal, the advance signal and the signal produced by button $S_1$ are applied to respective inputs of the second AND gate circuit 11, thus enabling the same. Accordingly, the advance pulse from the logical time counting circuit 8 is applied to the minute correction terminal Sm of the logical time counting circuit 8 via the second AND gate circuit 11. Accordingly, the time information of the logical time counting circuit 8 is shifted each time it receives the advance pulse. In other words, the time display is shifted one minute at each one second thus providing the minute correction.

Like the time confirming operation, during the correction operation too, the clock pulse from the logical time counting circuit 8 is normally applied to the counter circuit 6 so that it is reset each time the button $S_1$ is depressed. However, under a condition in which the correction mode is designated, upon disappearance of the signal produced by button $S_1$, counter circuit 6 steps. In the same manner as has been described with reference to the time confirming operation when the counter counts the clock pulses of a predetermined number, that is when a predetermined time elapses, the counter produces an output which is applied to the reset terminal R of the correction mode designation circuit 9 and the reset terminal R of the display mode designation circuit 6 thereby resetting these circuits. Consequently, the correction mode that has been set in the logical time counting circuit 8 is released. The signal from the display mode designation circuit 7 also disappears thus transferring from the display mode to the non-display mode. In other words, the electronic timepiece is switched from the correction mode in which power is consumed for the time display to the non-display mode in which no power is consumed for the time display.

In the electronic timepiece described above, time confirmation is performed by switching the operation of the timepiece from the non-display mode to the display mode by depressing button $S_1$, whereas the time correction is made by depressing button $S_1$ for switching the timepiece from the non-display mode to the display mode, then depressing button $S_2$ for setting the logical time counting circuit 8 to the time correction mode (at this time the display mode is switched from a condition of displaying hours and minutes to a condition of displaying the time information of the hour digits alone), then depressing again button $S_1$ to advance the time information of the hour digits to a predetermined o'-clock, and then depressing again button $S_2$ to switch the logical time counting circuit 8 from the hour correction mode to the minute correction mode (at this time the display mode is switched from a condition for displaying the hour digits alone to the condition for displaying only the time information of the minute digits) followed by the depression of button $S_1$ for advancing the time information of the minute digits to a predetermined minute. The counter circuit 6 continues to count the number of the clock pulses sent from the logical time counting circuit and is reset by the signal produced by button $S_1$ or $S_2$ to renew the counting operation. If no signal is supplied by button $S_1$ under a designated correction mode the counter circuit 6 continues to count the number of the clock pulses supplied by the logical time counting circuit 8 and when the counter circuit 6 counts a predetermined number of the clock pulses, for example 60 pulses, namely, a predetermined period of 60 seconds elapses (when the clock pulse has a period of one second), a signal is applied to the correction mode designation circuit 9 and the display mode designation circuit 7 thus resetting these circuits. During said predetermined period the displayed content at the display device is not changed, thus the same data is displayed continuously. Consequently, the correction mode that has been set in the logical time counting circuit 8 is released. Further, as the display mode designation signal applied to the logical time counting circuit 8 from the display mode designation mode 7 disappears the time information to the display device 12 from the logical time counting circuit 8 is also stopped thus switching from the display mode to the non-display mode. In other words, the electronic timepiece is switched to the non-display mode in which no power is consumed for the time display from the correction mode in which power is consumed for the time display.

Consequently, even when the correction operation is interrupted in the time correction mode of the timepiece and such mode is continued for some reason, the timepiece is automatically switched to the non-display mode from the correction mode after a predetermined period thereby effectively preventing waste of power.

It will be clear that the invention is by no means limited to the specific embodiment described above. Thus, for example, in an electronic timepiece provided with a mode which is used to constantly display whether the timepiece is operating normally or not, for example a mode in which a display element is lighted and extinguished at each one second, the operation is returned from the correction mode to such mode consuming less power. It is also clear that the invention is also applicable to an electronic timepiece having a display mode and a correction mode for seconds, dates, months, etc. other than hours and minutes.

What we claim is:

1. An electronic timepiece provided with a counter circuit for producing a reset signal upon counting a predetermined number of clock pulses, whereby the operation mode of the timepiece is automatically switched from a correction mode in which power is consumed for the time display to a non-display mode in which no power is consumed for the time display when the same data is displayed over a predetermined period in the correction mode.

2. An electronic timepiece comprising a logical time counting circuit for generating a time information, an advance pulse and a clock pulse; a first designation circuit to be set by a signal from first externally operable input means to supply a timing information output designation signal to said logical time counting circuit for causing the same to produce a time information; a display device for displaying a time corresponding to said time information produced by said logical time counting circuit; a second designation circuit to be set by a signal from second externally operable input means to supply a correction mode designation signal to said logical time counting circuit for setting the same to a correctable condition; a logical circuit responsive to a signal produced by said first input means when said logical time counting circuit is set at a correction mode for supplying the advance pulse to a time correction signal input terminals of said logical time counting circuit; a counter circuit for counting the number of the clock pulses produced by the logical time counting circuit for providing a reset signal to said first and second designation circuits when a predetermined number of the clock pulses has been counted thus resetting said first and second designation circuits for stopping the output designation signals produced thereby; said counter circuit being connected to be reset by a signal produced by said first input means; whereby when said display device displays the same data for a predetermined period under a condition wherein said logical time counting circuit is set to said correction mode in which power is consumed for the time display, said timepiece is automatically transferred to a non-display mode in which no power is consumed for the time display by the reset signal from said counter circuit.

* * * * *